US006309088B1

(12) United States Patent
Chen

(10) Patent No.: US 6,309,088 B1
(45) Date of Patent: Oct. 30, 2001

(54) COMBINED PENCIL SHARPENER AND INK STAMP WITH ILLUMINATION DEVICE

(75) Inventor: Chen-Yi Chen, Hsi Chih (TW)

(73) Assignee: Taiwan Stamp Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/585,851

(22) Filed: Jun. 1, 2000

(51) Int. Cl.[7] ..... B43L 23/00; B41L 47/02

(52) U.S. Cl. ..... 362/253; 362/119; 362/103; 30/457; 446/491; 101/98; 101/368

(58) Field of Search ..... 362/253, 119, 362/109; 30/451, 459, 457; 472/1, 25; 446/491; 101/98, 368

(56) References Cited

U.S. PATENT DOCUMENTS 5,161,587 * 11/1992 Wu ..... 144/28.5
5,579,692 * 12/1996 Collier ..... 101/405
5,738,011 * 4/1998 Tay ..... 101/368
6,032,580 * 3/2000 Lee ..... 101/368
6,224,236 * 5/2001 Shu ..... 362/205
6,249,981 * 6/2001 Shu ..... 30/457
6,253,673 * 7/2001 Chen ..... 101/98

* cited by examiner

*Primary Examiner*—Stephen Husar
*Assistant Examiner*—Anabel Ton
(74) *Attorney, Agent, or Firm*—Thorp Reed & Armstrong LLP

(57) ABSTRACT

The invention discloses a combined pencil sharpener and an ink stamp being able to give off light. The invention includes a pencil sharpener and a stamp which are slidably engaged together. When a pencil is inserted into an opening of the pencil sharpener, it will move the sharpener towards the stamp and then conduct a circuit contained in a housing of the stamp to allow an LED to give off light. The invention will not only increase the attractiveness of the sharpener but also be very helpful to teach a young user to sharpen a pencil.

5 Claims, 7 Drawing Sheets

COMBINED PENCIL SHARPENER AND INK STAMP WITH ILLUMINATION DEVICE

BACKGROUND OF THE INVENTION

1. Field of the Invention

The invention relates to a combined pencil sharpener and ink stamp which is able to give off light during a pencil sharpening process.

2. Description of Related Art

Pencil sharpeners are especially used by children to sharpen pencils and ink stamps are used by people to repeatedly print certain characters or pictures. Up to now, pencil sharpener manufacturers have only made their efforts on improving the appearances of the sharpeners to attract their young customers. Thus, it will be advantageous if a pencil sharpener is provided combined with an ink stamp being able to give off light during the process of pencil sharpening.

SUMMARY OF THE INVENTION

The main objective of the invention is to provide a pencil sharpener combined with an ink stamp having the ability of giving off light during the process of pencil sharpening to increase the appeal to consumers.

Another objective of the invention is to provide a pencil sharpener combined with an ink stamp having the ability of giving off light in the process of pencil sharpening thus being able to teach a child user how to properly use a pencil sharpener.

Other objects, advantages and novel features of the invention will become more apparent from the following detailed description when taken in conjunction with the accompanying drawings.

BRIEF DESCRIPTION OF THE DRAWINGS

FIG. 3 is a cross-sectional view of the invention with the ring blocker being engaging on;

FIG. 7 is a cross-sectional view of the invention with the ring blocker being removed and a pencil being inserted in;

DETAILED DESCRIPTION OF THE PREFERRED EMBODIMENT

Figure 1:
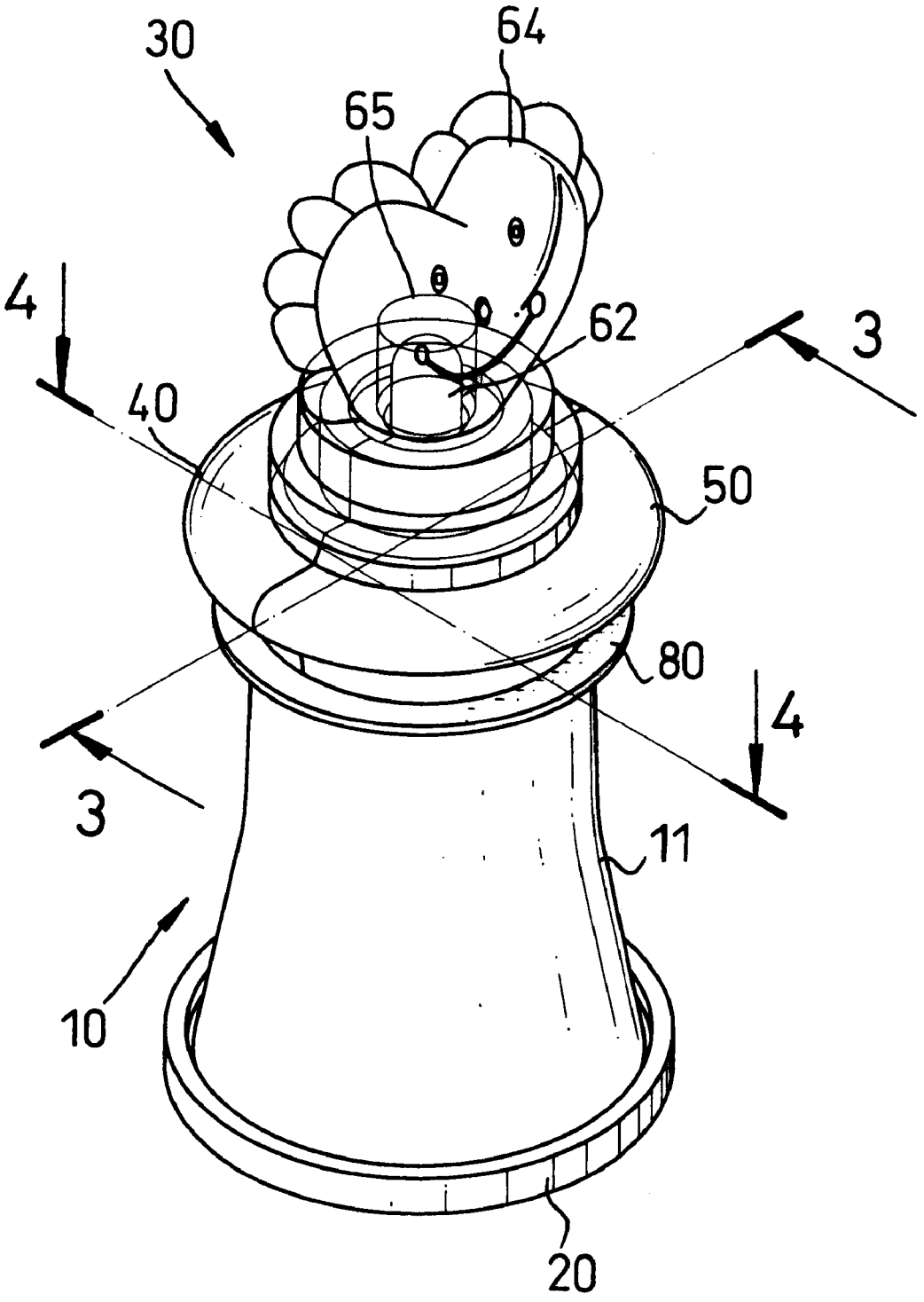
FIG. 1 is a perspective view of a combined pencil sharpener and ink stamp with illumination device in accordance with the present invention.
Figure 2:
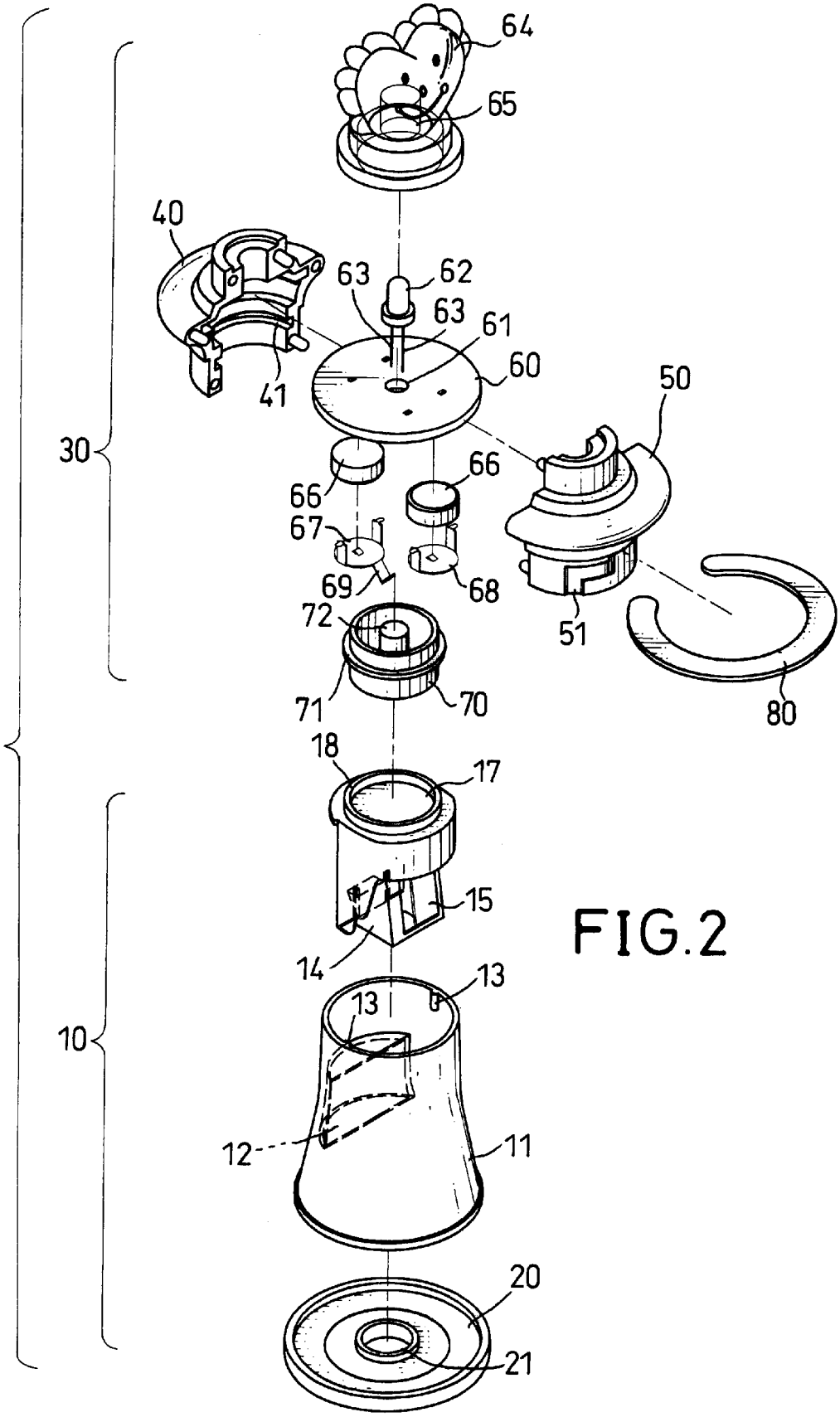
FIG. 2 is an exploded view of the invention shown in FIG. 1.

Shown in FIGS. 1 and 2 is the invention combining a pencil sharpener (10) and a stamp (30) being able to give off light during a pencil sharpening process.

Figure 3:
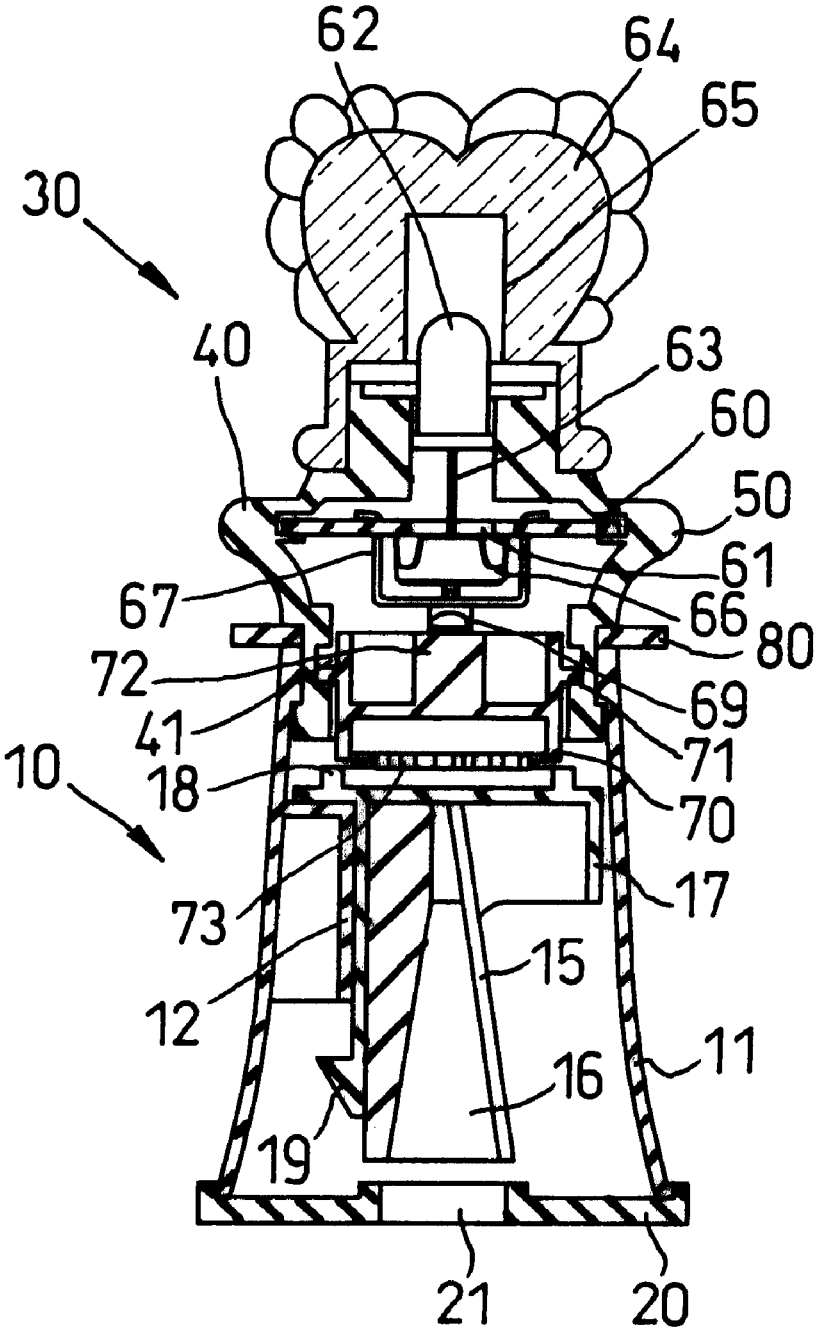

Referring to FIGS. 2 and 3, the pencil sharpener (10) has a barrel-like shell (11) an upper edge of which is circular, a blade set (14) having an opening (16) for receiving an end of a pencil and a blade (15), and a slidable seat (17) covering the blade set (14).

The shell (11) has at least one direction bar (13) longitudinally formed on an inner surface of the shell (11). The function of which will be described hereinafter. In the embodiment shown in FIG. 2, the shell (11) has two opposite direction bars (13). A baffle (12) in form of a plate which is parallel to an axis of the shell (11) is securely formed on an inner surface of the shell.

The blade set (14) is as the same as a conventional one used for sharpening a pencil but in this invention, it is contained in the slidable seat (17). The slidable seat (17) is made of elastic materials and has a top flange (18) and a flat side face, which, when the slidable seat (14) is put into the shell (11) from above, is able to intimately face-to-face contact with the baffle (12), as shown in FIG. 3.

Referring back to FIG. 2, the stamp (30) includes a housing having a left half (40) and a right half (50) being able to be coupled together, and a circuit board (60) having a central opening (61) and being securely received in the housing.

An LED (62) is mounted above a top face of the circuit board (60), and has two legs (63) extending through the central opening (61) and fixed to an under face of the circuit board (60).

Two batteries (66) are respectively attached to the circuit board (60) by means of a first conductive clip (67) and a second conductive clip (68).

A conductive leg (69) is formed on the first conductive clip (67) at one end thereof, with a free end extending just under the second conductive clip (68).

A stamp seat (70) is contained in the housing by means of a side flange (71) thereof being slidably held by a circular groove (41) defined in the housing. The seat (70) has a central protrusion (72) located close to an underside of the leg (69).

The LED (40) protrudes from the housing so that light emitted therefrom can be seen. A transparent lampshade (64) having a hollow path (65) in that the LED (62) can be installed on the housing, as more clearly shown in FIG. 3. The lampshade (64) can be a cartoon character.

A rubber pad (73), as shown in FIG. 3, having inscriptions thereon can be attached to the seat (70) facing downward to form an ink stamp.

Figure 9:
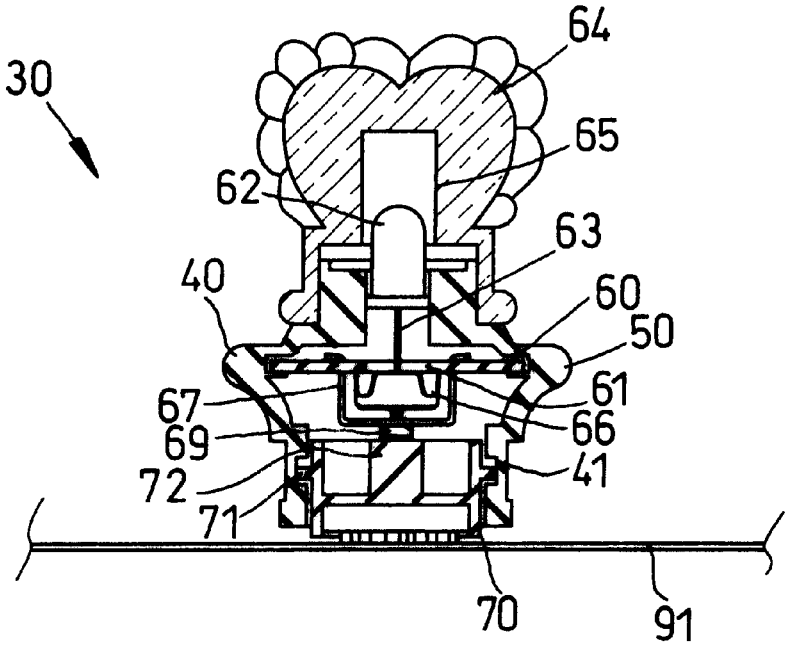

A cover (20) having a central bore (21) is attached to a bottom end of the shell (11) of the sharpener. The central bore (21) is used to receive an end of a pencil (90), as shown in FIG. 9.

Referring to FIG. 2, at least one L-shaped slit (51) is defined in a bottom portion of the housing. In the preferred embodiment of the invention, two L-shaped slits (51) are defined to mate with the direction bars (13) formed on the shell (11).

Figure 4:
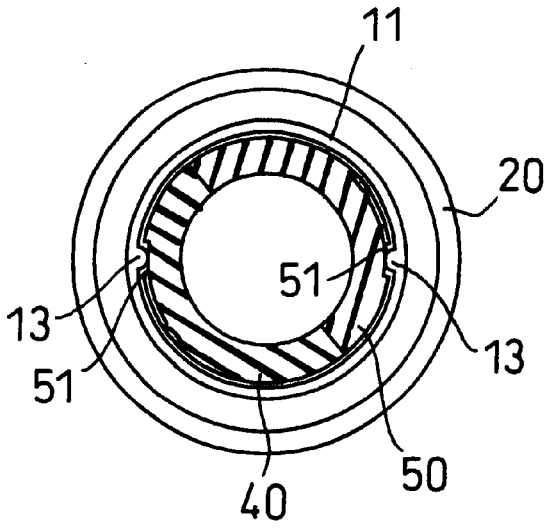
FIGS. 4 and 5 are cross-sectional views of the invention showing the locking operation of the pencil sharpener and the stamp.
Figure 5:
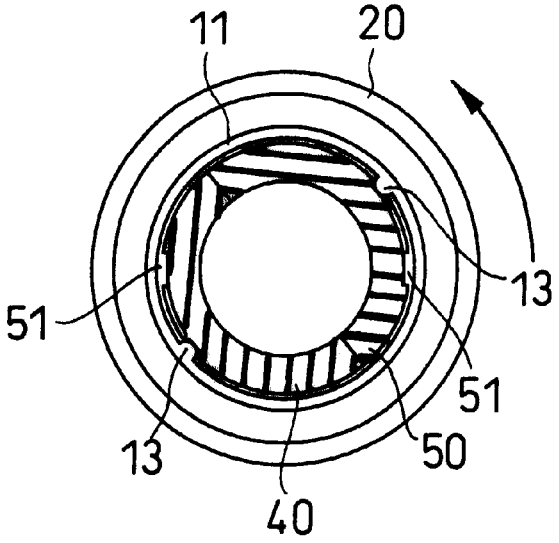
Figure 6:
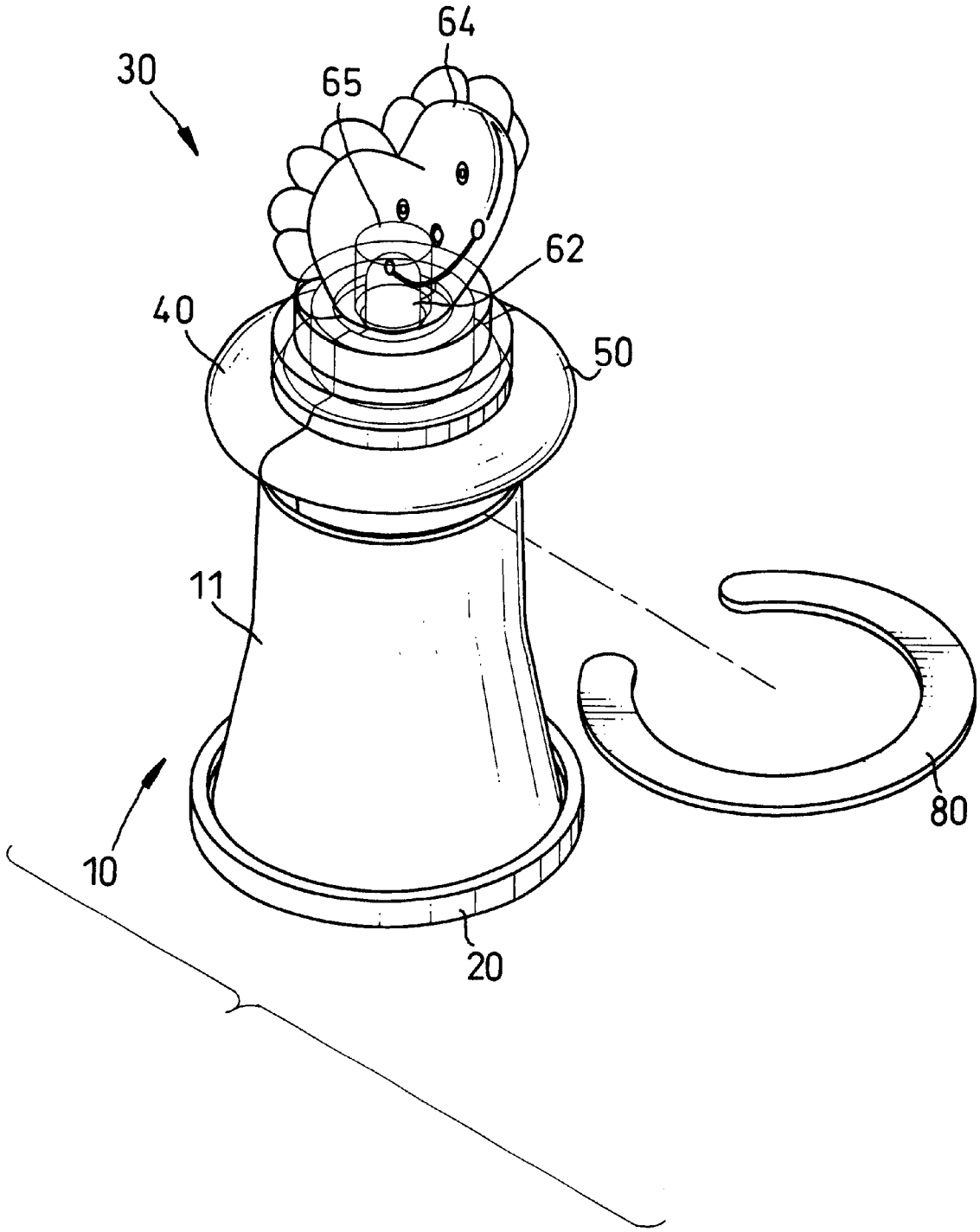
FIG. 6 is a perspective view of the invention with the ring blocker being removed.
Figure 7:
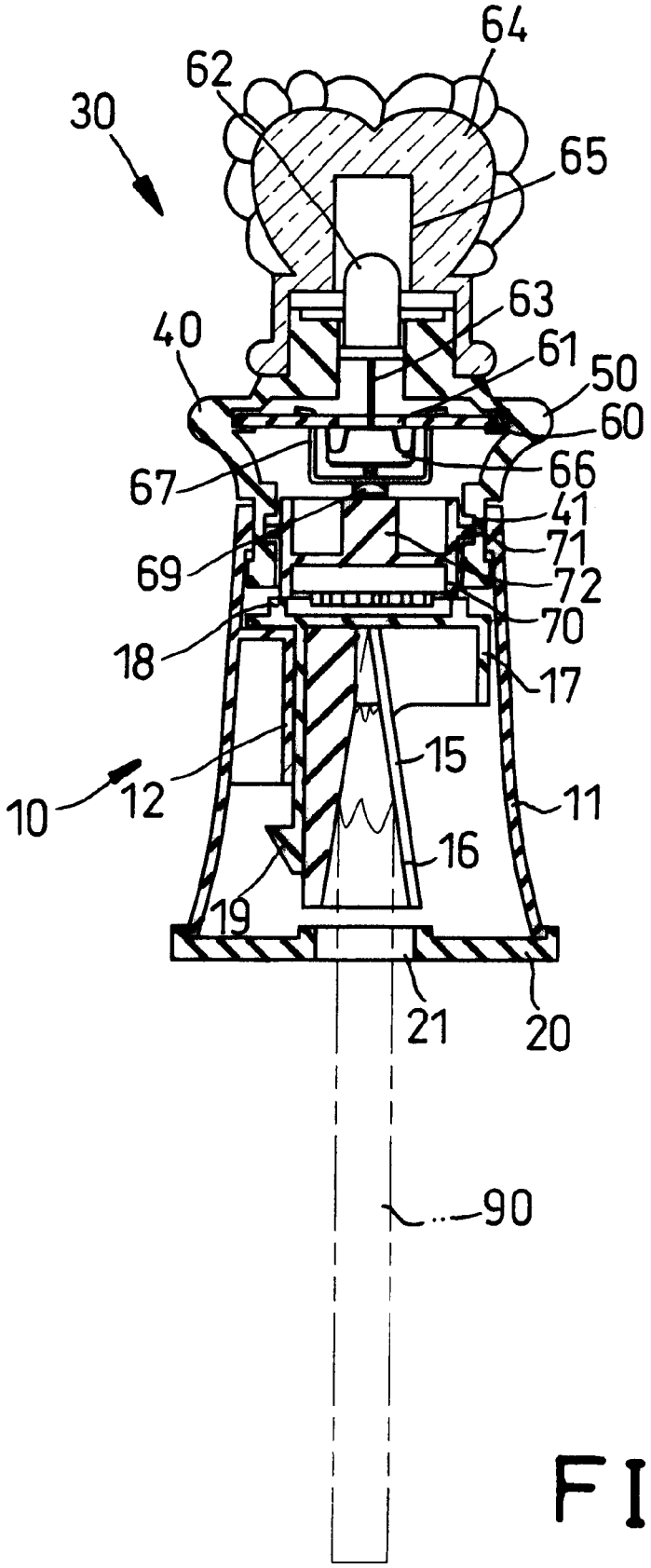

In assembly, a ring stopper (80) is first placed on the bottom portion of the housing. Then the shell (11) is brought to approach the housing with the two direction bars (13) aligned with the respective L-shaped slits (51), as shown in FIG. 4. Next, the housing and the shell (11) are pushed towards each other, and then the shell (11) is rotated with respect to the housing. The direction bars (13) are sized to respectively enter the L-shaped slits (51) and then retained in the respective slit (51). The pencil sharpener (10) of the invention assembled is as shown in FIG. 1. Reverse to above assembly steps, the shell (11) and the stamp can be detached and the ring stopper (80) can be removed. Then the shell (11) and the housing can be assembled again, as shown in FIG. 6. As shown in FIG. 7, at this time, an end of a pencil (90) can be inserted into the opening (16). When inserted, the pencil (90) will push the blade (15), and thus the seat (17) upward to push the stamp seat (70) upward. Then the central protrusion (72) pushes the leg (69) upward to meet the second conductive clip (68) and then finally complete a circuit to allow the LED (62) to emit light.

Figure 8:
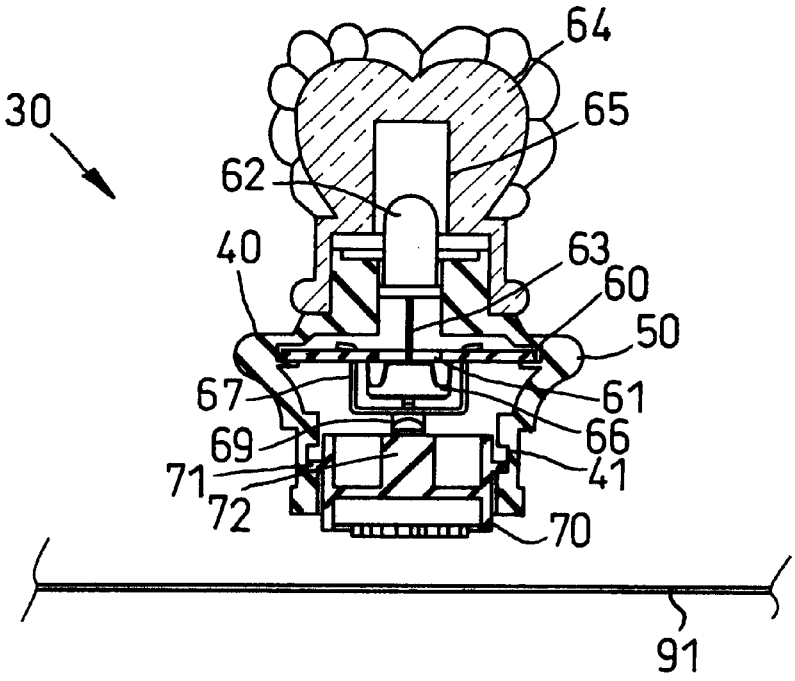
FIG. 8 is a cross-sectional view of the invention with the pencil sharpener being removed and the stamp being ready for printing on a paper; and, FIG. 9 is a cross-sectional view of the invention with the pencil sharpener being removed and the stamp being pressed down to the paper to print.

When the sharpener (10) and the stamp (30) are detached, the stamp (30) can solely be used as a stamp being able to give off light. FIGS. 8 and 9 show the operation of the stamp (30) in printing on a piece of paper (91).

Referring to FIG. 7, pressing the stamp (30) downward with respect to the shell (11) at this time can make the leg (69) move downward to first meet the central protrusion (72) and then be pushed by the central protrusion (72) to eventually complete the circuit to make the LED (62) to emit light, even without the pencil. But back to FIG. 3, because of the existence of the ring stopper (80), the stamp (30) cannot be pressed downward with respect to the shell (11). So the ring stopper (80) can prevent the circuit being completed by inadvertently pressing down the stamp (30) with respect to the shell (11) in case of, for example, storage or selling.

A hook (19) is provided at a lower portion of the flat side face of the slidable seat (14). It can prevent the slidable seat (14) from sliding out of the shell (11) when the stamp (30) is removed.

An assemble combined pencil sharpener with ink stamp either having a ring stopper (80), as shown in FIG. 3, or without the ring stopper (80), as shown in FIG. 7, can be used for pencil sharpening and will emit light during sharpening process. In either situation, a pencil must be inserted into the opening (16) and then be pushed inward to make the LED (62) give light, and this is just what sharpening the pencil needs. Therefore the invention will be helpful in teaching a young user how to correctly use a pencil sharpener.

From above description, it could be understood that compared with the conventional sharpener, the invention will be fascinating to customers as it is able to give off light during the process of pencil sharpening. Furthermore, this sharpener will be very helpful in teaching a child to sharpen a pencil.

What is claimed is:

1. A combined pencil sharpener and ink stamp with illumination device comprising: a pencil sharpener (10) having:

a barrel-like shell (11);

a blade set (14) having a blade (15) and a opening (16) for receiving an end of a pencil; and a slidable seat (17) having a top flange (18) and covering the blade set (14) and being attached to a baffle (12) formed on an inner surface of the shell (11); a stamp (30) having:

a housing having a left half (40) and a right half (50) being able to be coupled together, a circuit board (60) securely held in position in the housing and having a central opening (61);

an LED (62) mounted above a top face of the circuit board (60) and having two legs (63) extending through the central opening (61) and fixed to an under face of the circuit board (60);

two batteries (66) respectively attached to the circuit board (60) by means of electrically connecting to a first conductive clip (67) and a second conductive clip (68);

a conductive leg (69) formed on the first conductive clipper (67) at one end thereof, with a free end extending under the second conductive clipper (68);

a stamp seat (70) having a central protrusion (72), a rubber pad (73) having inscriptions thereon attached to the seat (70) and facing downward to form an ink stamp, and a side flange contained in the housing and being slidably held by a groove (41) defined in the housing for containing the stamp seat (70); and at least one L-shaped slit (51) defined in a bottom portion of the housing to correspond to the direction bar (13).

2. The combined pencil sharpener and ink stamp with illumination device as claimed in claim 1, wherein a transparent lampshade (64) having a central hollow path (65) defined for containing the LED (40) is installed on the housing.

3. The combined pencil sharpener and ink stamp with illumination device as claimed in claim 1, wherein a stopper ring (80) is provided to secure the connection of the housing.

4. The combined pencil sharpener and ink stamp with illumination device as claimed in claim 1, wherein a cover (20) having a central opening (21) is provided to a bottom of the shell (11).

5. The combined pencil sharpener and ink stamp with illumination device as claimed in claim 2, wherein the lampshade (64) is made to be a cartoon character.

* * * * *